United States Patent [19]

Lindner

[11] 4,230,319

[45] Oct. 28, 1980

[54] PUTTING STROKE PRACTICE DEVICE

[76] Inventor: Max E. Lindner, 2516 N. 22nd Dr., Phoenix, Ariz. 85009

[21] Appl. No.: 937,167

[22] Filed: Aug. 28, 1978

[51] Int. Cl.[3] ..... A63B 69/36

[52] U.S. Cl. ..... 273/192; 273/176 FB

[58] Field of Search ..... 273/186 C, 192, 191 R, 273/176 FB, 191 A, 191 B; 46/30

[56] References Cited

U.S. PATENT DOCUMENTS

| | | | |
|---|---|---|---|
| 1,519,711 | 12/1924 | Withey | 46/30 |
| 2,894,755 | 7/1959 | Scelzo | 273/192 |
| 3,199,246 | 8/1965 | Fischer | 46/30 X |
| 3,473,811 | 10/1969 | Lees | 273/191 R X |

FOREIGN PATENT DOCUMENTS

| | | | |
|---|---|---|---|
| 218526 | 5/1957 | Australia | 273/192 |
| 1063586 | 3/1967 | United Kingdom | 273/186 C |

*Primary Examiner*—George J. Marlo
*Attorney, Agent, or Firm*—Herbert E. Haynes, Jr.

[57] ABSTRACT

A device for practicing putting strokes includes flexible side walls which enclosingly define the putter's swing area and the intended travel path of a struck golf ball so that a faulty putting swing may be detected when the struck ball deviates from the intended path. The side walls extend between a spaced pair of vertical support surfaces and are adjustably demountably interlaced in slots therein so that the spacing between the supports and the spacing between the side walls may be altered. The flexible side walls may be formed by a single elongated flexible strap. Weighted stabilizer blocks may be attached to the outwardly facing surfaces of the side walls. The practice device may also be configured to provide for anchoring of the supports to suitable fixed objects.

7 Claims, 4 Drawing Figures

PUTTING STROKE PRACTICE DEVICE

BACKGROUND OF THE INVENTION

1. Field of the Invention

This invention relates to golf practice devices, and more particularly to a putting stroke practice device.

2. Description of the Prior Art

The importance of proper putting in the game of golf has long been known, and just how important that phase of the game is will be appreciated upon consideration of the fact that approximately 50% of the strokes allowed on a par 72 regulation length 18 hole golf course, are used in putting alone. In addition to this large percentage of the strokes allowed, putting for most players is one of, if not the most, difficult golfing skills to master, and provides a constant challenge even to the most skillful players.

The basic problem in putting is that of perfecting a stroke that will direct the club head against the golf ball along a straight line coincident with the intended path of travel of the ball, while at the same time addressing the ball with the club head perpendicular to this straight line of approach to the ball by the club head. Though seemingly a simple requirement, this putting stroke must be precise and made within extremely narrow limits. The slightest deviation in the direction of travel of the club head in its approach to the ball or any deviation from the perpendicular position of the club head to the line of travel during the impact on the ball, will cause the ball to deviate from the desired path.

Most golfers are well aware of the fundamental precision required in putting and they attempt to achieve this by applying the various elements of form recommended by professionals in executing the stroke such as the proper club grip, the stance, the back swing, down swing and follow-through. However, since each golfer is different, he must learn exactly to what degree his grip, stance, and swing must be altered slightly in order to maintain a straight line of travel of the club head during all portions of the swing while keeping the face of the club head perpendicular or square to the intended path of the golf ball. It is extremely difficult for a golfer to ascertain exactly how close his actual stroke is to fulfilling these essential requirements of the proper putting stroke in that it is impossible for the human eye to detect the slight imperfections in the direction of travel of the golf club and the position of the head at the exact moment of impact.

For example, during the backswing, there is a natural tendency to roll the wrists and hands out clockwise. This opens the club face so that it does not remain square with the putting line. This tendency can be corrected by adjusting the positions of the hands on the shaft of the putter. However, the amount of adjustment and the exact proper position for the hands cannot be readily ascertained.

Many putting practice devices have been devised or suggested over the years and, in general, these prior art devices have achieved little or no commercial success for a variety of reasons, such as cost, complexity, difficulties in the set up and use thereof, and in some instances provided little or no benefit to a golfer who wanted to perfect his putting swing.

Some prior art devices include mechanisms that physically grip the head of the putter and restrainingly guide it through proper ball stroking squences. Such devices provide environments which are completely alien to a natural golf environment, and attempt to develop a proper and free putting swing by utilizing a controlled or otherwise restrictive swinging device.

Another prior art device includes a channel member of fixed width and having its length approximating that of the normal length of a putting swing. This particular prior art device provides inwardly extending flexible flaps within the channel which deflectingly engage the head of the putter in the event of a faulty swing. This device has several shortcomings; first, putting is done on an unnatural surface formed in the bottom of the channel member and a putter having a specific head length must be used; secondly, some clearance between the flaps and the opposite ends of the putter head must be provided so that a free and natural swing is possible, and that clearance eliminates the chance of detecting minor or relatively small swing imperfections; and thirdly, a faulty swing having an error of sufficient magnitude to cause the putter head to move into engagement with the flaps will be interrupted in that the head will be deflected or otherwise misaligned by engagement of the putter head with the flaps.

From the above and other prior art devices, one thing stands out as being common, in that they all provide some form of swing indicating, swing restricting, or swing error detecting mechanisms in the immediate area of the golf swing itself, with such mechanisms being inherently limited to the detection of relatively large errors in a golf swing. To the best of my knowledge, no prior art device additionally provides means for detection of improper putting swings in which the errors are of relatively small magnitude, in that they lack a device which facilitates visual comparison of the actual travel path of a struck ball with an intended travel path.

Therefore, it is desirable to provide a new and improved putting stroke practice device which overcomes some of the drawbacks and shortcomings of the prior art.

SUMMARY OF THE INVENTION

In accordance with the present invention a new and improved device for the practicing of putting strokes is disclosed as including elongated flexible side walls which enclosingly define the putter swing area and the intended travel path of a struck golf ball. The enclosingly defined putter swing area is useful for detecting relatively large errors in faulty putting swings, and the enclosingly defined area which indicates the intended travel path, provides means for visually detecting relatively small imperceptible swing errors which cause a struck ball to deviate from the intended travel path.

The elongated flexible side walls of the practice device of the present invention extend between a spaced pair of supports and are adjustably demountably connected thereto so that the spacing between the supports and the spacing between the side walls may be altered. The adjustable spacing of the supports will allow the device to be employed in various areas in that the spacing can be reduced to allow the device to be used in the relatively restricted confines of a room, or on the other hand, the supports can be spacedly extended, within practical limits, for use in areas of unrestricted size such as on a practice putting green. The spacing between the side walls allows the practicing golfer to use the putter of his choice, in that the spacing can be adjusted to suit the length of any putter head.

Since the practice device of the present invention is completely open on the bottom, it may be used in ay environment such as on an elongated strip of artificial grass, on a rug, or on natural grass. In addition, the instant device is provided with means for demountably anchoring the supports to suitably spaced objects, such as furniture legs, trees, pegs and the like.

Accordingly, it is an object of the present invention to provide a new and useful device for the practice of putting strokes.

Another object of the present invention is to provide a new and improved device for the practice of putting strokes which is simple to use and inexpensive to manufacture.

Another object of the present invention is to provide a new and improved device for the practice of putting strokes which may be used on any suitable surface.

Another object of the present invention is to provide a new and improved device for the practice of putting strokes which is adjustable in length to allow usage in a multiplicity of areas and so that putts of different lengths may be practiced.

Another object of the present invention is to provide a new and improved device for the practice of putting strokes which is adjustable in width to accommodate putter heads of different lengths.

Another object of the present invention is to provide a new and improved device for the practice of putting strokes which enclosingly defines the putter swing area and the intended travel path of a struck golf ball.

Another object of the present invention is to provide a new and improved device for the practice of putting strokes, of the above described character in which the enclosingly defined putter swing area is employed for the detection of improper swing strokes in which the errors are of relatively large magnitude.

Another object of the present invention is to provide a new and improved device for the practice of putting strokes of the above described character in which the enclosingly defined intended travel path of a struck golf ball is useful in providing visual comparison of the actual travel path of a struck golf ball with the intended travel path for detecting relatively small imperfections in the putting stroke.

Still another object of the present invention is to provide a new and improved device of the above described character which includes elongated flexible side walls demountably and adjustably coupled so as to extend between a spaced pair of supports, and may also be provided with means for anchoring of the supports to suitable fixed objects.

The foregoing and other objects of the present invention, as well as the invention itself, may be more fully understood from the following description when read in conjunction with the accompanying drawings.

DESCRIPTION OF THE PREFERRED EMBODIMENT

Figure 1:
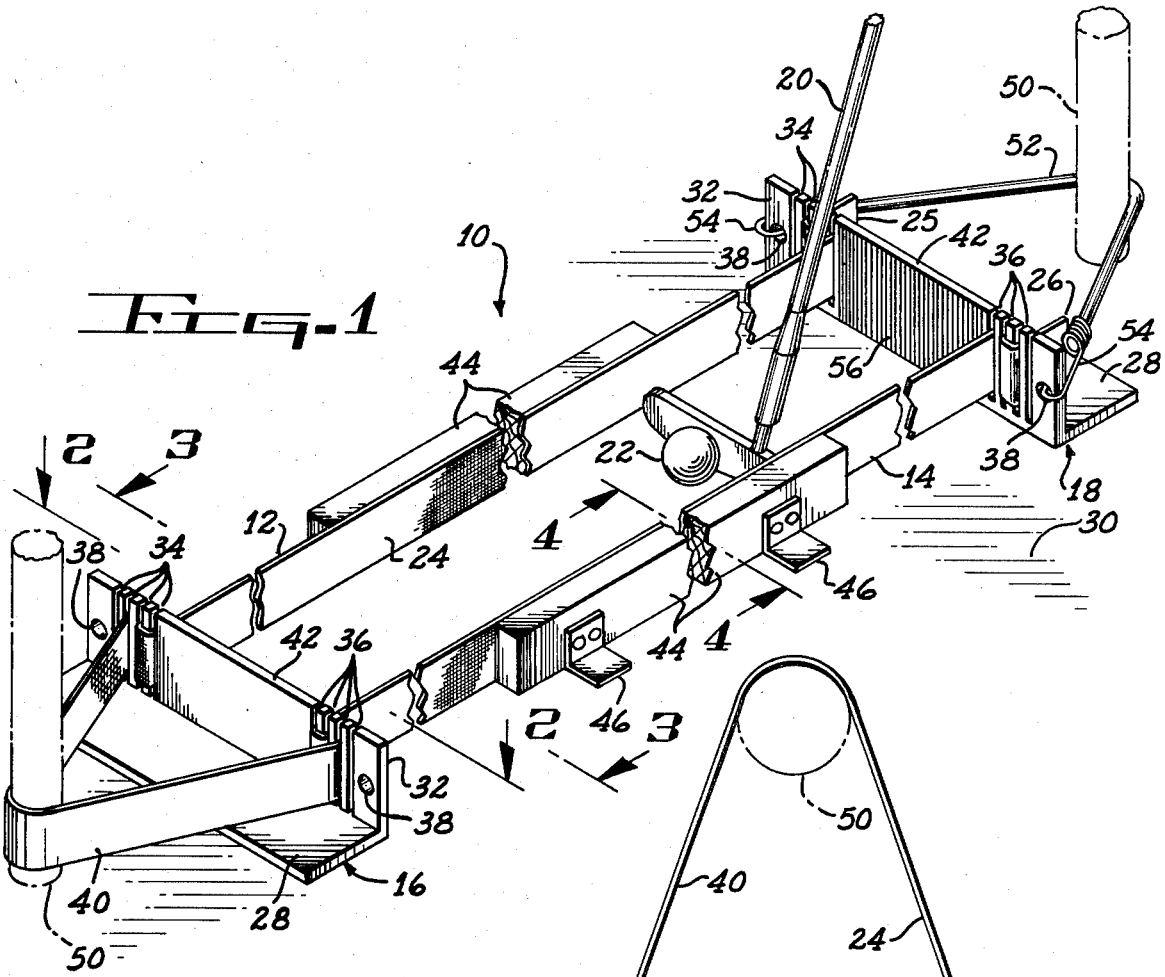
FIG. 1 is a fragmentary isometric view of the practice device of the present invention and illustrates the various features thereof.

Referring more particularly to the drawings, FIG. 1 illustrates the putting stroke practice device of the present invention which is indicated in its entirety by the reference numeral 10. As will hereinafter be described in detail, the putting stroke practice device 10 includes a spaced pair of elongated side wall means 12 and 14 which are demountably and adjustably connected to a spaced pair of support means 16 and 18 so as to extend therebetween.

It should be understood that the putting stroke practice device 10 is shown in FIG. 1 in a considerably foreshortened manner for illustrative purposes, and that the spacing between the support means 16 and 18 may be of any suitable distance, and, for practical purposes is preferrably about 12 feet. Thus, with such a distance between the support means 16 and 18, and the spacing between the side wall means 12 and 14, it will be seen that a putter 20 can be placed between the side wall means 12 and 14 and swung in the normal manner so as to strike the golf ball 22 which is disposed adjacent one end of the device to cause it to move toward the opposite end thereof. Thus, the putting stroke practice device 10 enclosingly defines both the putter swing area and the intended travel path of the struck golf ball.

As seen in FIG. 1, the side wall means 12 and 14 are preferrably formed of a single elongated strap 24 having opposite ends 25 and 26, and which may be of any suitable flexible material such as woven cotton webbing, nylon webbing, plastic and the like. In the above mentioned preferred embodiment, wherein the spacing between the support means has a maximum of about 12 feet, the elongated strap 24 would be approximately 27 or 28 feet in length and should be approximately one and one-half inches in width.

The support means 16 and 18 are preferrably in the form of an identical pair of metallic angle brackets each having a horizontally disposed flange 28 for restingly engaging the putting surface 30, and each having an integral upstanding surface 32 to which the side wall means 12 and 14 are attached as will hereinafter be described in detail. The angle brackets 16 and 18 may be fabricated of any standard metallic angle stock, such as of aluminum with the flanges 28 and surfaces 32 having width dimensions of about two and one-half inches and the angle brackets may be fabricated in lengths of approximately nine inches.

The surfaces 32 of the angle brackets 16 and 18 each have a plurality of spacedly arranged transverse slots 34 formed adjacent one of their ends, and an identical plurality of spacedly arranged transverse slots 36 formed adjacent their opposite ends. Further, the surfaces 32 of each of the angle brackets also are provided with a pair of apertures 38 formed therethrough, with each of the apertures 38 being disposed adjacent a different one of the opposite ends of the surfaces in which they are formed.

To assemble the putting stroke practice device 10 of the present invention, the free end 25 of the elongated strap 24 is interlacingly disposed in the transverse slots 34 of the angle bracket 18 with the strap extending therefrom toward the oppositely positioned angle bracket 16 where it is in interlaced engagement with the transverse slots 34 of the angle bracket 16. In this manner, the portion of the strap 24 which extends between the aligned slots 34 of the oppositely positioned angle brackets 16 and 18 will be disposed in an on edge attitude and will constitute the side wall 12 of the putting stroke practice device 10. The opposite free end 26 of the elongated strap 24 is in interlaced engagement with the slots 36 of the angle bracket 18 and the strap extends therefrom toward the opposite angle bracket 16 where it interlacingly engages the transverse slots 36 of that bracket. Therefore, that portion of the strap 24 which extends between the aligned slots 36 of the spaced angle brackets 16 and 18 will be disposed in an on edge attitude and will constitute the side wall 14 of the device 10.

Figure 2:
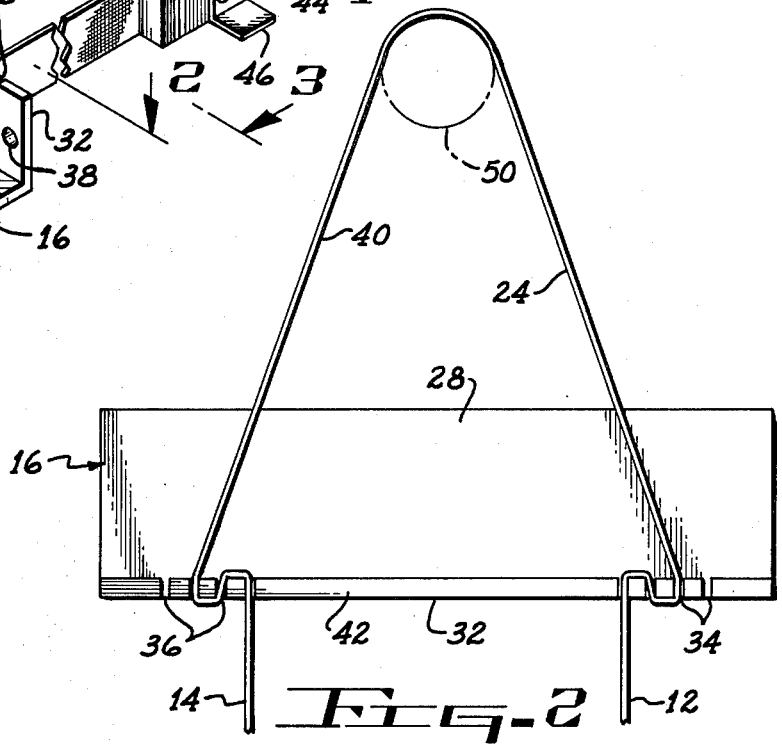
FIG. 2 is an enlarged fragmentary plan view of a portion of the practice device of the present invention taken along the line 2—2 of FIG. 1.

The intermediate portion of the elongated strap 24 extends rearwardly from the surface 32 of the angle bracket 16 and forms a looped portion 40 which may be employed for anchoring the angle bracket 16 as will hereinafter be described. As seen best in FIGS. 2 and 3, the transverse slots 34 and 36 are formed in the angle brackets 16 and 18 so as to open upwardly onto the upper longitudinal edge 42 of the surfaces 32, with that configuration facilitating demountable connection of the strap 24 to the angle brackets 16 and 18. That same open top configuration of the sots 34 and 36 also facilitates rearrangement of the interlaced connection of the strap 24 in the slots so that the spacing between the side walls 12 and 14 can be adjusted to accommodate putter heads having different length dimensions. To insure a clear understanding of the adjustment in the spacing between the side walls 12 and 14, reference is made in particular to FIG. 2 wherein it will be seen that the side walls 12 and 14 both extend from the innermost one of the slots 34 and 36 in which they are interlacingly mounted. If, for example, the interlaced coupling of the side wall 12 in the slots 34 of the brackets 16 and 18 were rearranged so that the strap extended between the next outboard laterally adjacent slots rather than from the innermost ones, the spacing between the side walls 12 and 14 would be increased by one increment, that is, equivalent to the spacing between those slots. Thus, it will be seen that either or both of the side walls 12 and 14 can be moved so as to in effect incrementally adjust the spacing between the side walls.

It has been determined as a result of extensive research that the putters on the market today will vary in length, i.e., the distance between the heal and toe of the putter head, from slightly under five inches to about seven inches. Therefore, the preferable spacing between the innermost ones of the slots 34 and 36 is five inches, and the spacing between the outermost ones is seven and one-fourth inches, with the spacing between each of the individual slots being identical and being preferably three-eights of an inch.

Figure 4:
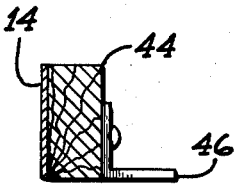
FIG. 4 is an enlarged sectional view taken along the line 4—4 of FIG. 1.

The spacing between the oppositely disposed support means 16 and 18 can obviously be shortened if desired by simply coupling the elongated strap 24 so that more of the opposite ends 25 and 26 extend rearwardly from the support 18. However, since that spacing can be quite long, as evidenced by the hereinbefore suggested length of 12 feet, the putting stroke practice device 10 is provided with stabilizing means for maintaining the upright on edge attitude of the side walls 12 and 14. As seen best in FIGS. 1 and 4, the stabilizing means includes a pair of blocks 44 each affixed to the outwardly disposed surface of a different one of the side walls 12 and 14, such as with suitable adhesive, staples, thumb tacks or the like. The blocks 44 may be fabricated of any suitable material such as wood, and may have angle tabs 46 affixed thereto to enhance the stabilizing capability of the blocks 44.

It will be understood that the stabilizing blocks 44 can be of any suitable length such as for example, 3 feet, with each block affixed intermediate the opposite ends of their respective side walls 12 and 14. Alternately, instead of one relatively long stabilizer block 44 being affixed to each of the side walls, a plurality of shorter blocks (not shown) can be employed at spaced intervals along the lengths of the side walls.

Since the side walls 12 and 14 are formed of a flexible material, the necessity of keeping those walls relatively taught during use of the putting stroke practice device 10 will be obvious. This necessary tautness of the side walls 12 and 14 can be accomplished by forming the angle brackets 16 and 18 with sufficient weight to resist movements thereof. The hereinbefore described preferred embodiment of the brackets being formed of aluminum or similar material, will lack sufficient weight to resist such unwanted movement; however, weights could be added, such as by affixing relatively heavy metal blocks (not shown) to the upwardly facing surfaces of the flanges 28 of the support brackets 16 and 18.

The addition of weights (not shown) to an otherwise relatively light product may not be the most practical way of accomplishing the desired objective in that the weights would reduce the portability of the device 10, would increase shipping costs, packaging costs, and the like.

Therefore, the putting stroke practice device 10 is preferably provided with anchoring means by which the angle brackets 16 and 18 may be demountably attached to suitably spaced fixed objects 50 such as pegs driven into the ground, trees, furniture legs, and the like. The intermediate loop portion 40 of the elongated strap 24 can be employed as the means for anchoring the support angle bracket 16, with an elastic cord 52 serving to anchor the opposite bracket 18. The elastic cord 52 is provided with a hook 54 on each of its opposite ends so that the cord can be looped about the fixed object 50 with the hooks 54 demountably engaged in the apertures 38 formed in the surface 32 of the angle bracket 18.

An obvious modification of the putting stroke practice device 10 would be to fabricate the side walls 12 and 14 of a pair of separate straps (not shown), rather than the single elongated strap 24. In such a modified device, the above described anchoring requirement of the support brackets 16 and 18 could be accomplished by employing a pair of the elastic cords 52.

From the above detailed description, it is believed that the use of the putting stroke practice device 10 will be readily apparent. However, the following operational description is given for completeness of this disclosure and to insure against misconceptions.

With the device 10 set up as described above, a practicing golfer places the golf ball 22 in the swing area between the side walls 12 and 14 adjacent one of the support brackets 16 or 18, and places the putter 20 so that its head is immediately adjacent the ball. The golfer then swings the putter in his normal manner and hits the ball toward the opposite end of the device 10. In the event that the golfer's backswing or downstroke are extremely erratic, i.e., not following a straight line, the putter head will move into contact with one or the other of the enclosing side walls, and the golfer will know immediately that his swing is very erratic, and can take corrective measures. However, if the golfer's swing is only slightly erratic to the extent that the putter clears the side walls during the swing, such a slightly erratic swing, which may be imperceptible to the naked eye, will become immediately obvious due to the actual path of the struck golf ball deviating from the intended path defined between the spaced side walls 12 and 14. Thus, if a struck golf ball hit one or the other or bounces back and fourth between the side walls, the golfer will know that his swing is erratic and can practice that swing until perfected.

Figure 3:
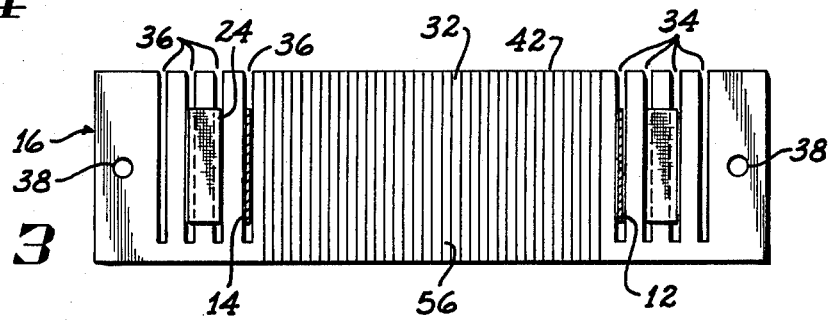
FIG. 3 is an enlarged sectional view taken along the line 3—3 of FIG. 1.

It will be seen that the golf ball 22 can be hit from either end of the device 10 which facilitates the practicing of the putting strokes and as shown best in FIGS. 1 and 3, the inwardly facing surfaces of the upstanding surfaces 32 of the support angle brackets 16 and 18 are each provided with a suitably marked target area 56 located centrally thereof. The target areas 56, which are marked such as with a contrasting color, have a width dimension which is equal to the diameter of the holes or cups (not shown) employed on the greens of golf courses.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What is claimed is:

1. A putting stroke practice device comprising:

(a) a spaced pair of support brackets each having a vertical surface, said support brackets positionable with their respective vertical surfaces facing each other;

(b) a pair of elongated strap members each having opposite planar surfaces and each formed of thin flexible material, said pair of strap members each extending between said pair of support brackets in spaced parallel relationship with the opposite planar surfaces of said strap members being vertically disposed;

(c) said pair of strap members and said pair of support brackets restingly positionable on any surface which is suitable for putting for enclosingly defining a portion of that surface as having a putter swing area and an intended travel path of a struck golf ball;

(d) connection means formed adjacent each of the opposite side edges of the vertical surfaces of said pair of support brackets for demountably connecting said pair of strap members to said pair of support brackets, said pair of strap members adjustably positionable in said connection means for varying the spacing between said pair of support brackets and for varying the spacing between said pair of strap members; and (e) anchoring means extending rearwardly from each of said pair of support brackets for demountably attaching said support brackets to fixed objects.

2. A putting stroke practice device as claimed in claim 1 wherein said connection means comprises a plurality of laterally spaced vertically extending slots formed adjacent each of the opposite side edges of the vertical surfaces of said support brackets, each of said plurality of slots adapted to interlacingly receive a different portion of said pair of strap members therein.

3. A putting stroke practice device as claimed in claim 2 wherein said pair of strap members are interlacingly repositionable in each of said plurality of slots for adjusting the lengths of said strap members to suit the spacing between said pair of support brackets.

4. A putting stroke practice device as claimed in claim 2 wherein said pair of strap members are interlacingly rearrangeable in each of said plurality of slots so as to extend from different ones of those slots to adjust the spacing between said pair of strap members.

5. A putting stroke practice device as claimed in claim 1 and further comprising stabilizing means attached to each of said pair of flexible strap members for maintaining the vertical dispositions thereof.

6. A putting stroke practice device as claimed in claim 5 wherein each of said stabilizing means comprises at least one stabilizer block affixed to the outwardly facing surface of its respective one of said pair of strap members.

7. A putting stroke practice device as claimed in claim 1 wherein said pair of strap members are formed by a single elongated flexible strap having its opposite ends connected to one of said pair of support brackets by the ones of said connection means formed therein and having the intermediate portion of said strap connected to the other of said pair of support brackets by the ones of said connection means formed therein, the intermediate portion of said strap forming a loop which extends rearwardly of the one of said pair of support brackets to which it is connected.

* * * * *